United States Patent [19]

Liu

[11] Patent Number: 4,552,428

[45] Date of Patent: Nov. 12, 1985

[54] ELECTRICAL PLUG

[76] Inventor: Ling H. Liu, No. 97, Lane 192, Shui Yuan Rd., Fong-Yen City, Taiwan

[21] Appl. No.: 384,433

[22] Filed: Jun. 2, 1982

[51] Int. Cl.[4] ..... H01R 11/20

[52] U.S. Cl. ..... 339/97 P; 339/97 R

[58] Field of Search ..... 339/97 R, 95 R, 98, 339/99 R, 97 C, 219 R, 223 R, 272 R, 272 A

[56] References Cited

U.S. PATENT DOCUMENTS

| | | | |
|---|---|---|---|
| 1,173,099 | 2/1916 | Davis | 339/98 |
| 2,785,386 | 3/1957 | Mason | 339/97 R |
| 2,989,720 | 6/1961 | Rivkin | 339/99 R |
| 3,372,361 | 3/1968 | Wengen | 339/97 R |
| 3,836,943 | 9/1974 | Horak | 339/97 P |
| 3,902,780 | 9/1955 | Dola | 339/98 X |

FOREIGN PATENT DOCUMENTS

| | | | |
|---|---|---|---|
| 1765202 | 7/1971 | Fed. Rep. of Germany | 339/99 R |
| 2226285 | 12/1973 | Fed. Rep. of Germany . | |
| 969956 | 12/1950 | France | 339/99 R |
| 2083293 | 3/1982 | United Kingdom | 339/98 |

*Primary Examiner*—William R. Briggs

*Attorney, Agent, or Firm*—Saidman, Sterne Kessler & Goldstein

[57] ABSTRACT

An improved electrical plug includes a plug body of insulating material with front and rear end faces, a plurality of conducting prongs fixedly disposed in the plug body with the front portions projecting through the front end face of the plug body, a plurality of blind channels formed within the plug body through the rear end face adjacently parallel to the conducting prongs for receiving the insulated conductors therein, and a plurality of manually driving knobs coupled with the plug body in conjunction with the conducting prongs. Each of the driving knobs has a screw member secured to the inner side thereof, and a rectangular serrated member movably attached to the end of the screw member with the pointed teeth facing the blind channel, so that, by turning the driving knobs, the teeth perforate the insulation of the conductors without twisting the conductors, and firm electrical connections can be easily and quickly made without requiring any tools and skill.

2 Claims, 5 Drawing Figures

ELECTRICAL PLUG

BACKGROUND OF THE INVENTION

This invention relates to an electrical plug which includes an electrical connector for connecting conducting prongs and entering insulated conductors without stripping off the insulating layer.

In common practice, to connect a wire to a conventional plug as shown in FIG. 1*a*, it is necessary to disassemble the plug and strip off the insulating layer of a conductor to expose some extent of the conductor so that it can be made contact with the conducting prongs of the plug. For simplifying the connecting work this inventor offered an improved form of plug, as shown in FIG. 1*b*, that is disclosed in a U.S. Application Ser. No. 151,199. This form of plug is provided with conducting prongs having teeth at the ends thereof to be driven into the conductors which enter the plug body so that the insulating layer of the conductors are perforated and the inner conductors thereof respectively come into contact with the teeth. The driving force is given to a screw, by which the insulated conductor is pushed against the teeth, by using tools, such as, screw drivers. Although the requirement of stripping the insulated layer is neglected in that case, inconvenience still exists due to the need of tools.

SUMMARY OF THE INVENTION

An improved electrical plug having a plug body with front and rear end faces, and a plurality of conducting prongs fixedly disposed in the plug body with their front portions respectively projecting through the front end face, wherein the improvement comprises; a plurality of blind channels formed within the plug body through the rear end face adjacently parallel to the conducting prongs for facilitating the insertion of insulated conductors; and a plurality of electrical connecting means threadedly coupled with the plug body in conjunction with the rear portions of the conducting prongs and the front portions of said blind channels for respectively making electrical connections between the conducting prongs and the insulated conductors received in the blind channels; so that electrical connections can be easily and quickly done without requiring any tools and skill.

Advantageously, each of the electrical connecting means may include a driving knob suitable for hand operations, a conductive screw member fixed to the driving knob and extending at right angle toward the blind channel in the plug body through a threaded opening formed in the rear portion of the conducting prong thereof; and a rectangular serrated member movably attached to the end of the conductive screw with the pointed teeth facing the blind channel for penetrating into the insulated layer of the conductor received within the blind channel; so that, by manually turning the driving knob, electrical connections between the prongs and the insulated conductors therein can be easily and quickly made without stripping off the insulating layer of the conductors.

An object of the invention is to provide an electrical plug which has an electrical connector provided with pointed teeth at the end thereof and non-conductive knob provided for driving the teeth by hand to come into contact with an inner conductor of the wire by penetrating through the insulating layer thereof.

This and other objects, features and advantages of the present invention will be more apparent in the following description of a preferred embodiment with reference to the accompanying drawings, in which:

DETAILED DESCRIPTION OF THE PREFERRED EMBODIMENT

Figure 1A:
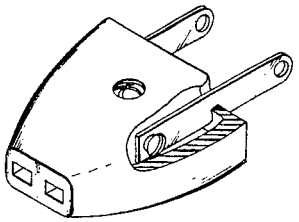
FIG. 1a PRIOR ART
FIGS. 1*a* and 1*b*, respectively, show perspective views of plugs in the prior art.
Figure 1B:
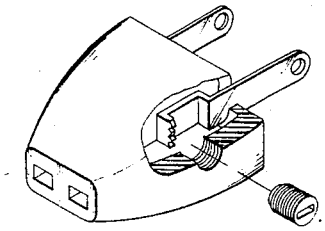
FIG. 1b PRIOR ART
Figure 2:
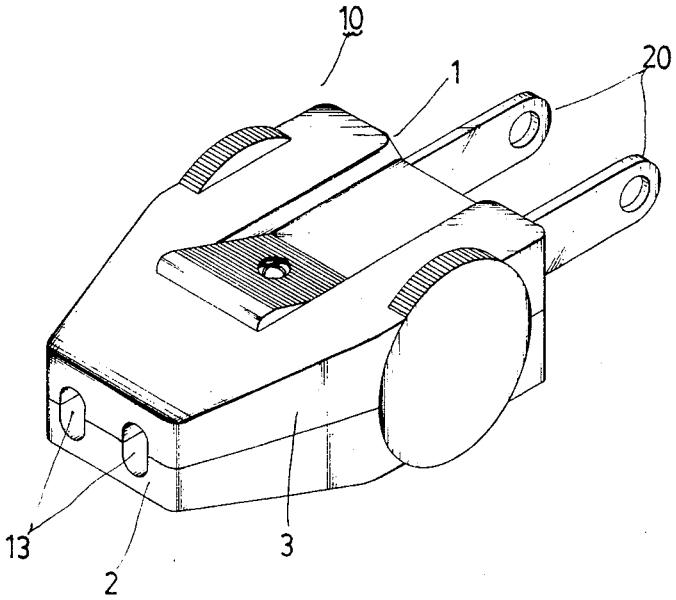
FIG. 2 is a perspective view of a plug according to the invention.
Figure 3:
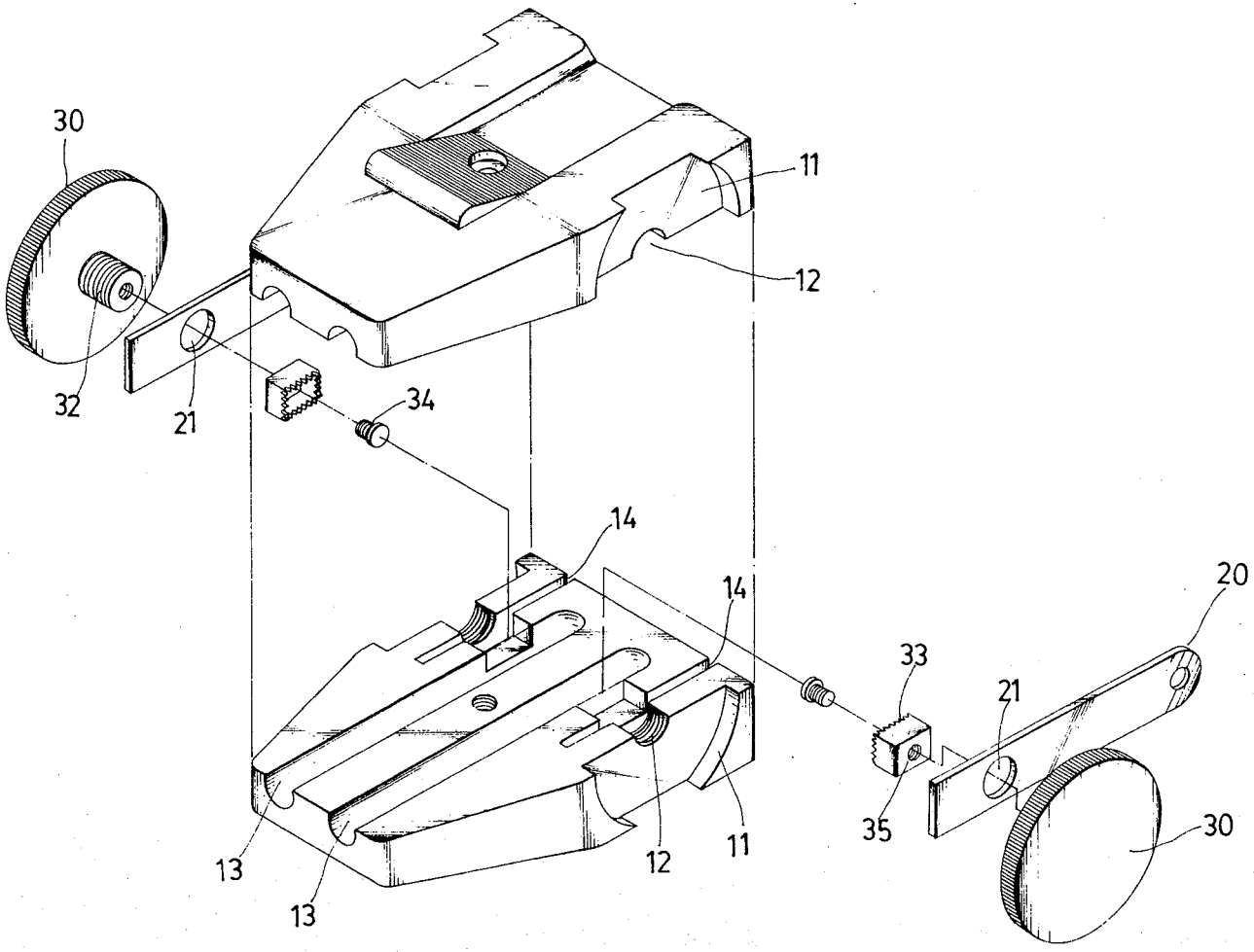
FIG. 3 is an exploded view of the plug according to the invention.
Figure 4:
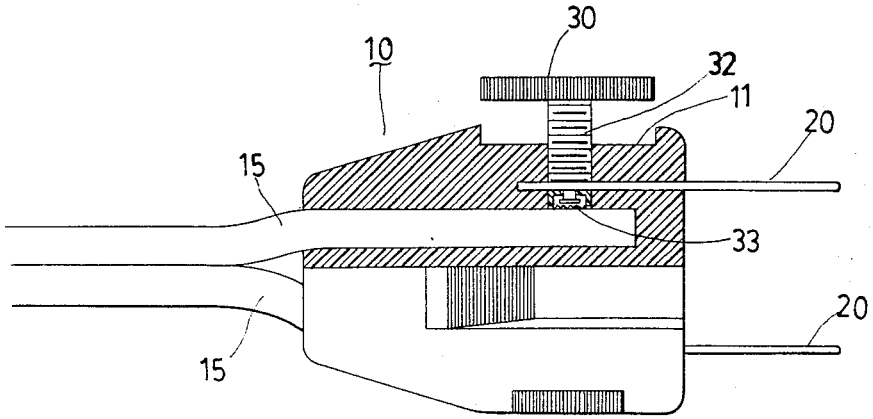
FIG. 4 is a partially sectioned view of a plug according to the present invention.

As shown in FIGS. 2, 3 and 4, an electrical plug according to the invention includes a plug body 10 made of an electrically insulating material and having two halves of molded sections coupled to substantially form a shape which has a front end face 1 and rear end face 2 interconnected by side faces 3. At the front end face 2 a pair of conducting prongs 20 are forwardly projecting for insertion into a socket. The rear portions of the prongs 20 are respectively received in grooves 14 in the plug body 10 and each of them has a circular threaded opening 21 near each rear end thereof. For receiving the entering insulated conductors 15 a pair of blind channels 13 are bored at the rear end face 2 with some extent of its front portion extended in a parallelly adjacent position relative to the respective rear portion of the prongs 20.

At each side face 3 of the plug body 10 is provided with a recess 11 adapted to receive a circular knob 30 which forms a part of the electrical connector according to the invention. A slot 12 is bored at the center of the end face of each recess 11 and crisscrosses the groove 14. The ends of the slots 12 are extended until they communicate respective blind channels 13. The knobs 30 are rotatably mounted in the respective recesses 11 and fixedly connected to respective conductive screws 32, i.e. the shank portions of the electrical connector in this invention, which are threadedly movable in the slots 12 and threadedly passing through the openings 21 upon operating the knobs 30. At each end of the screws 32 is a serrated member, having axially pointed teeth 33 which are projected laterally from the raised edges of a rectangular piece 35, movably attached to the screw 32 by means of an attached screw 34 so that the serrated member only axially moves when the screw 32 threadedly moves. These teeth 33 can be moved in direction at right angle to the respective entering insulated conductors 15 upon the threaded movement of the screws 32.

It can be noted that the connecting work in this plug can be easily done by inserting insulated conductors into the blind channels 13 and drivingly turning the knobs 30. As the knobs 30 are operated the respective teeth 33 are driven to penetrate through of the insulating layers of the respective conductors 15 and come into contact with the respective conductors, thereby making electrical connections between the entering conductors 15 and the conducting prongs 20 which are kept in contact with the conductive screws 32.

It can be further noted that the plug described with reference to FIG. 4 is suitable for wires, i.e. insulated conductors, having larger cross section to obtain good electrical contacts and firm attachment to the plug.

Figure 5:
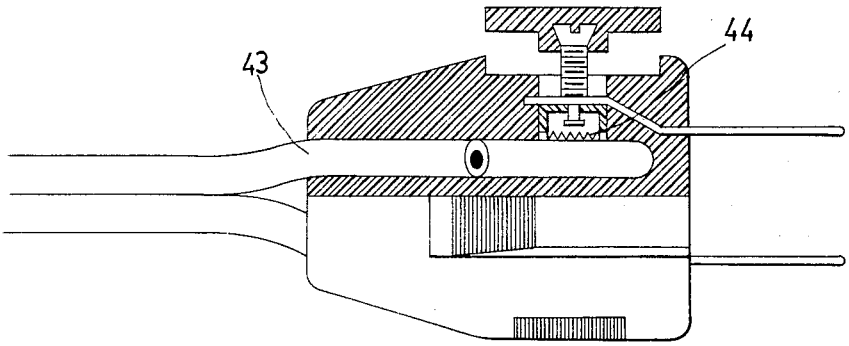
FIG. 5 is a partially sectioned view of a plug in another form according to the invention.

For wires of smaller cross section, to get good electrical contact and firm attachment to the plug, it is advantageous to construct the plug as shown in FIG. 5 in which the slot for receiving the conductors 43 are made to be elliptical. The conductor 43 is inserted into the slot with some extent of its end portion bent back and extending rearward after it reaches the end of the slot. Therefore the area of the conductor that can be in contact with the serrated member 44 will become larger.

With the invention thus explained, it is apparent that obvious modifications and variations can be made without departing from the scope of the invention. It is therefore intended that the invention be limited only as indicated in the appended claims.

What I claim is:

1. An electrical plug comprising a plug body with front and rear end faces interconnected by side faces;

a plurality of grooves formed in the plug body through the front end face;

a plurality of conducting prongs fixedly disposed in the grooves with their front portions respectively projecting through the front end face;

a plurality of blind channels formed in the plug body through the rear end face with the inner portion thereof extending into the plug body adjacently parallel with the rear portions of said grooves and communicating with said grooves to create an opening in a wall between adjacent ones of said grooves and said blind channels, such that the blind channels are unobstructed by said prongs for facilitating the insertion of insulated conductors into said channels;

an externally disposed driving means suitable for hand operation;

a conductive screw member having one end fixed to said driving means and extending into said plug body toward said blind channel through a threaded opening formed in the rear portion of said conducting prong;

a rectangular serrated member having teeth arranged in substantially perpendicular rows so that a row of teeth is adjacent to each of correspondingly substantially perpendicular walls of the rectangular channel in the plug body wherein said serrated member is rotatably disposed at the other end of said conductive screw, said drive means being operable to move said serrated member axially in said opening and substantially perpendicularly relative to the longitudinal axis of said insulated conducting member to complete an electrical connection between said conducting prong in the groove and said insulated conducting member received in the adjacent blind channel, said serrated member and said opening cooperating to substantially prevent rotational movement of said serrated member and to permit axial movement of the serrated member under the control of the driving means without inducing torque in said insulated conductor, without stripping the insulated layer from said insulated conductor, and without the need for any tools.

2. An electrical plug, comprising:

a plug body with front and rear end faces interconnected by side faces;

a plurality of grooves formed in the plug body through the front end face;

a plurality of conducting prongs fixedly disposed in the grooves with their front portions respectively projecting through the front end face;

a plurality of blind channels formed in the plug body through the rear end face with the inner portion thereof extending into the plug body adjacently parallel with the rear portions of said grooves and communicating with said grooves through a substantially rectangularly shaped opening in a wall between adjacent ones of said grooves and said blind channels, such that the blind channels are unobstructed by said prongs for facilitating the insertion of insulated conductors into said channels; and a plurality of manually-operated electrical connecting means threadedly coupled with the plug body and the prongs, and including an externally disposed driving knob suitable for hand operation, a conductive screw member having one end fixed to said driving knob and extending into said plug body toward said blind channel through a threaded opening formed in the rear portion of the conducting prong disposed in the groove adjacent said blind channel, and a serrated member of substantially rectangular cross-section connected to the other end portion of said conductive screw, said serrated member being movable axially toward and away from a conductor in said blind channel in a direction substantially perpendicular to the longitudinal axis of said blind channel, and being constrained by said opening between said channel and adjacent groove in the plug body, from motion in all directions except axially in said opening substantially perpendicularly to the longitudinal axis of said blind channel, said rectangular serrated member having teeth arranged in substantially perpendicular rows so that a row of teeth is adjacent to each of correspondingly substantially perpendicular walls of the rectangular channel in the plug body, so that, upon rotation of said driving knob in one direction, said serrated member is moved axially into electrical connection between the prongs in contact with a conductor in said blind channel without inducing a torque in said insulated conductor and without stripping the insulated layer from the conductor.

* * * * *